United States Patent [19]

Horeschi et al.

[11] Patent Number: 4,462,709

[45] Date of Patent: Jul. 31, 1984

[54] TYPE CARRIER RETURN AND PLATEN LINE SPACE DEVICE FOR TYPEWRITERS

[75] Inventors: Giancarlo Horeschi; Gian P. Barozzi, both of Tokyo, Japan

[73] Assignee: Tokyo Juki Industrial Co., Ltd., Tokyo, Japan

[21] Appl. No.: 281,414

[22] Filed: Jul. 8, 1981

[30] Foreign Application Priority Data

Jul. 16, 1980 [JP] Japan ..... 55-97409

[51] Int. Cl.[3] ..... B41J 19/70

[52] U.S. Cl. ..... 400/314; 400/314.6; 400/317.3; 400/334.3; 400/478; 400/549; 400/568; 400/664

[58] Field of Search ..... 400/313, 314, 314.1, 400/314.2, 314.3, 314.5, 314.6, 317, 317.3, 318, 334.3, 478, 549, 553, 568, 572, 573, 664

[56] References Cited

U.S. PATENT DOCUMENTS

| | | | |
|---|---|---|---|
| 2,879,876 | 3/1959 | Palmer et al. | 400/478 X |
| 2,902,133 | 9/1959 | Walton et al. | 400/317.3 X |
| 3,592,309 | 7/1971 | Craft et al. | 400/478 X |

OTHER PUBLICATIONS

IBM Selectric Typewriter Service Manual, published May, 1975, pp. 93–95.

*Primary Examiner*—Ernest T. Wright, Jr.
*Attorney, Agent, or Firm*—Koda and Androlia

[57] ABSTRACT

A carriage return device in a typewriter including: an interposer operable through operation of a key lever for the carriage return; a cycle bail driven by the interposer; a driving source adapted to rotate a main shaft by a predetermined number of rotations in association with the cycle bail; a cycle clutch for intermittently transmitting a driving force to the main shaft; an actuating bail for performing a cycle of movement having a locus of a predetermined mode to cause the interposer to disengage from the cycle bail; a carriage return bell crank for operating in association with the interposer when the interposer moves in the direction of disengaging from the cycle bail; a carriage return clutch operable by the carriage return bell crank; a carriage driving device for driving the carriage to return through operation of the carriage return clutch; and a mechanism for operating to return the carriage return bell crank upon completion of carriage return; wherein the carriage return device further includes a mechanism for releasing the carriage from an escapement rack in association with the carriage return bell crank.

2 Claims, 25 Drawing Figures

TYPE CARRIER RETURN AND PLATEN LINE SPACE DEVICE FOR TYPEWRITERS

BACKGROUND OF THE INVENTION

This invention relates to a carriage return device in a typewriter.

The conventional carriage return device has been of such an arrangement that a platen driver is pushed forward in a certain stroke by a cam for feeding paper which is secured to a main shaft, a lever for pressing a spring clutch for returning a carriage is locked within the aforesaid stroke, and, upon completion of the carriage return the aforesaid locking is released through the agency of a margin stop.

SUMMARY OF THE INVENTION

The present invention has as its object the provision of a carriage return device in a typewriter, being simplified in construction and capable of smoothly operating as compared with ones manufactured according to the conventional technique.

Namely, the present invention contemplates to provide a carriage return device in a typewriter, comprising:

- an interposer operable through operation of a key lever for the carriage return;
- a cycle bail driven by the interposer;
- a cycle clutch operationally associated with said cycle bail for intermittently transmitting a driving force from a driving source to the main shaft so that the main shaft can rotate by a predetermined number of times;
- an actuating bail for performing a cycle of movement having a locus of a predetermined mode to render a movement causing the interposer to disengage from the aforesaid cycle bail;
- a carriage return bell crank for operating in association with the interposer when the interposer moves in the direction of disengaging from the cycle bail;
- a carriage return clutch operable by the carriage return bell crank;
- a carriage driving device for driving the carriage to return through operation of the carriage return clutch; and
- a mechanism for operating to return the carriage return bell crank upon completion of carriage return;

wherein the carriage return device further comprises a mechanism for releasing the carriage from a stationary escapement rack in association with the aforesaid carriage return bell crank.

In the example as described above, when the key for the carriage return is pressed, the cycle bail 13 is rotated by the interposer 7 to turn the clutch bell crank 16, whereby the cycle clutch 44 is turned on to cause the main shaft 42 to make one turn.

This rotation of the main shaft 42 renders an elliptical motion of a predetermined mode to actuating bail 29 through a combination of cams 65, 66 and 67, a crank 68 and a bail guide 35.

While the interposer 7 operates in association with the motion of this actuating bail 29, a carriage return link 26 moves forwardly, whereby a carriage return bell crank 21 engaged therewith is rotated, thereby effecting the carriage return (a leftward movement of the carriage 60).

Since cycle bail 13 is prevented from turning during the carriage return, printing is precluded even if a printing key, etc. is accidentally pressed.

During the carriage return, an escapement rod 62 connected to a movement clutch 58 and a spring 63 turn an escapement torque bar 114, whereby an escapement pawl 117 of the carriage 60 is released from an escapement rack 119, thus enabling to obtain a quiet and smooth operation of carriage return.

Further, a back space rack link 123 operationally associated with the interposer 7 rotates a backspace rack 124 clockwise, whereby a printing arm 124A of the carriage 60 is stopped, so that printing can be prevented when the key for the carriage return is pressed.

Furthermore, a rope 84 connecting a left cord drum 81 to a carriage 60 is stretched through a cord tension pulley 88 and a yoke 93 supporting this pulley 88 is urged by a spring 94 lower in tension than a spiral spring 85 of a right cord drum 82, whereby, during the carriage return, the yoke 93 is moved rightwardly by a predetermined distance and an index pawl 103 operationally associated with the yoke 93 is raised to drive a platen 110, thereby enabling to effect the paper feed. In this case, a meshingly driven distance between the index pawl 103 and a platen drive 104 can be controlled by an index selector 107, so that the paper feed pitch can be regulated.

As apparent from the foregoing, according to the present invention, a carriage return device simplified in construction and operable reliably can be obtained.

Figure 1:
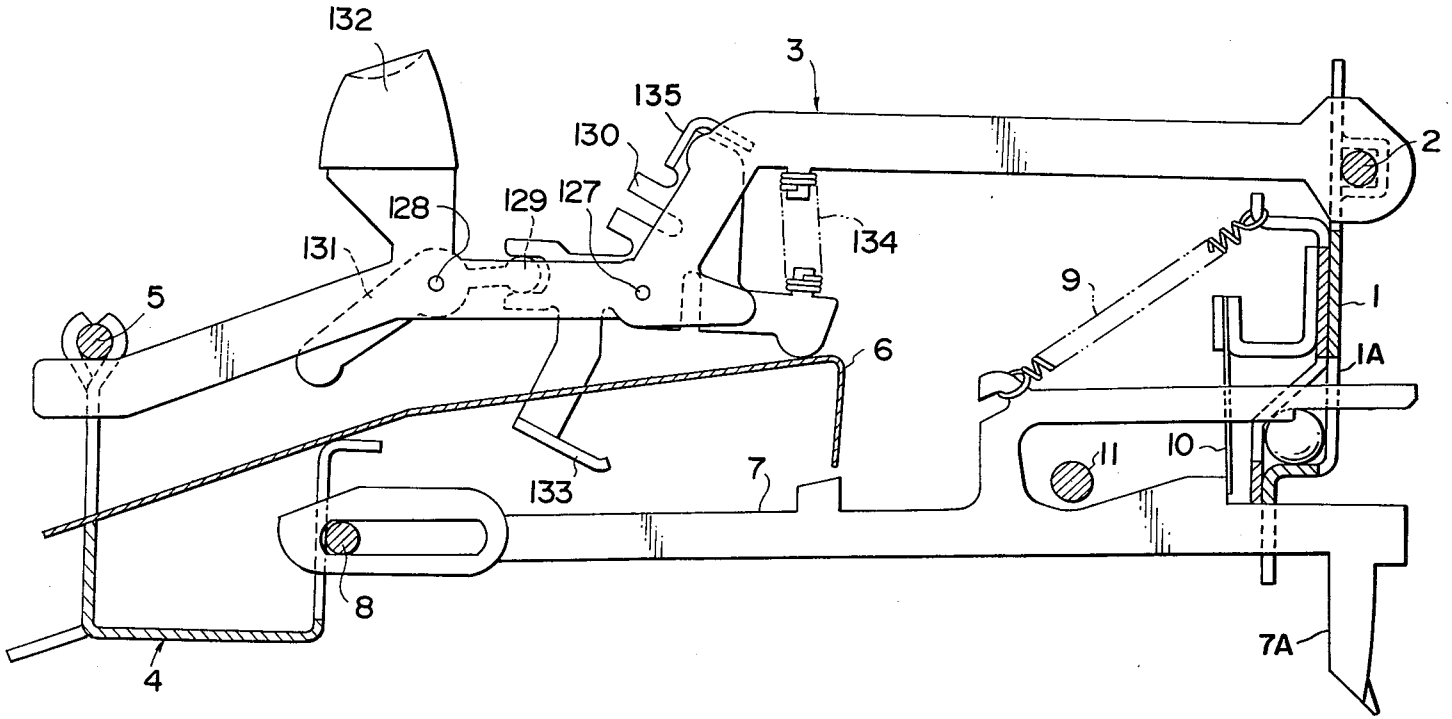
FIG. 1 is a left side view of the device of the present invention exemplifying the arrangement of the carriage return lever and interposer.

Description will hereunder be given of a preferred embodiment of the present invention with reference to the accompanying drawing.

PREFERRED EMBODIENT OF THE INVENTION

Referring to FIGS. 1 through 4, a carriage return lever 3 is rockingly journalled on a portion close to the right end of a shaft 2 provided along a laterally elongate rear guide 1 fixed on a frame 96 (shown in FIG. 16) of a typewriter. The forward portion of the carriage return lever 3 is controlled in this upward movement by a stop bar 5 secured to a laterally elongate front guide 4, and indirectly urged upwardly by a lever spring 6 which engages with a first repeat lever 130 which is coupled to the lever 3. An interposer 7 is located at a position corresponding to the carriage return lever 3, being guided by a rod 8 fixed on front guide 4 and a downwardly open cutout 1A formed in the rear guide 1, urged in the upward and rearward directions by a spring 9, and engaged with a stop spring 10 secured to the rear guide 1. In addition, reference numeral 11 indicates a down stop shaft for limiting the downward movement of the interposer 7.

A cycle bail 13 rocking about an axis 12 is disposed in the rear of the interposer 7. This cycle bail 13 is urged by a spring 14 in a direction in which the upper end thereof is directed rearwardly, i.e. in the clockwise direction as viewed fron the right side surface (to the right in the rotational direction).

A clutch bell crank 16 rocking about a shaft 15 is provided in the rear of the cycle bail 13 and at the right side of the typewriter. This clutch bell crank 16 is urged by a spring 17 in the counterclockwise direction and a forward end portion 18 at one side thereof extends over a step portion 20 formed at the forward end portion 19 at one side of the aforesaid cycle bail 13 and is engaged with the top surface of the cycle bail 13, i.e., maintained in the waiting state.

A carriage return bell crank 21 and the actuating arm 22 are rockingly journalled on the aforesaid shaft 15. The carriage return bell crank 21 is urged by a spring 23 in the counterclockwise direction, and the actuating arm 22 is urged by a spring 24 stretched between the carriage return bell crank 21 and itself to a position where it abuts against the carriage return bell crank 21 and is adapted to rock in the same direction as the carriage return bell crank 21. The left lower end portion of the carriage return bell crank 21 is connected to the carriage return link 26 through a pin 25. This carriage return link 26 is supported in a manner to be slidable back and forth, and a portion (the forward end portion 27) thereof projects into a perpendicular plane incorporating therein the interposer 7, and, when the interposer 7 moves forwardly, is engaged therewith and pulled out forwardly. In addition, this carriage return link 26 is secured thereto with a stop spring 28 for engaging the cycle bail 13, when moving forwardly, to prevent the cycle bail 13 from rotating in the counterclockwise direction (in a direction of clutch-on).

The cycle bail 13 is an elongate member laterally extending, and pivotally supported at opposite ends. An elongate actuating bail 29 also laterally extending is disposed under the cycle bail 13.

This actuating bail 29 is supported at the rear end thereof by two arms 31 fixed at laterally opposite ends of the shaft 30 rotatably supported at a position leftwardly of the shaft 15 and being concentric therewith. Namely, an elongate rod 32 is fixed on the rear end of the actuating bail 29, and opposite ends of the rod 32 are loosely coupled into two holes 33 at the forward ends of the two arms 31 so as to support the rod 32. Furthermore, a pin 34 studded at the left side surface of the forward portion of the actuating bail 29 is loosely inserted in a lateral slot 36 of a bail guide 35 so as to support the actuating bail 29. The bail guide 35 is disposed at the left side of the typewriter, a longitudinal slot 37 formed on the bail guide 35 is loosely coupled onto a stud 38 studded on a left hand side frame 96A (FIG. 14), whereby the bail guide 35 is vertically movably supported. This stud 38 additionally functions as a left side fulcrum for a rocking center pivot of the cycle bail 13.

Further, a latch member 39 is rockingly supported on the aforesaid stud 38. The latch member 39 is urged by a spring 40 in the clockwise direction (as viewed from the right side), prevented by the pin 34 from rotating, and provided at the lower end thereof with an abutting portion 41 for abutting against the actuating bail 29 when the actuating bail 29 moves excessively rearwardly. This abutting portion 41 causes the interposer 7 to reliably contact the actuating bail 29 during operation.

Figure 6:
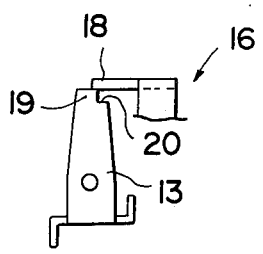
FIG. 6 is a right side view of the device of the present invention exemplifying the engagement of the cycle bail with the clutch bell crank in the waiting state.
Figure 7:
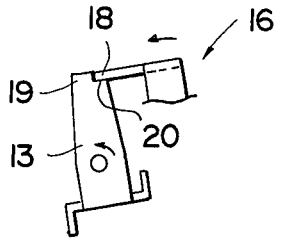
FIG. 7 is a right side view of the device of the present invention exemplifying the engagement of the cycle bail with the clutch bell crank during operation.

FIGS. 6 and 7 show the engagement of the cycle bail 13 with the clutch bell crank 16. As shown in FIG. 6, in the waiting state, the forward end portion 18 of the clutch bell crank 16 extends over the step portion 20 formed at the forward end portion 19 of the cycle bail 13 and is engaged with the top surface of the cycle bail 13. During operation, when the interposer 7 is pressed down by the key lever 3 to move rearwardly and urges the lower portion of the cycle bail 13, the cycle bail 13 turns in the counterclockwise direction, the clutch bell crank 16 rotates in the counterclockwise direction, and the forward end portion 18 of the clutch bell crank 16 is engaged with the step portion 20, so that the state shown in FIG. 7 is brought about. FIG. 7 shows the state of clutch-on to be described hereinafter.

In FIGS. 3 and 8 through 10, an elongate main shaft 42 laterally extending is rotatably journalled behind the shafts 15 and 30.

Rotatably coupled to the right side portion of the main shaft 42 is a drive pulley 43 with a sleeve 43A. The drive pulley 43 is driven by a motor 45A, and, when the power source is turned on, the drive pulley 43 is constantly rotatingly driven by the motor 45A regardless of whether a waiting state or an operating state is selected by the pressing-down of the key top 32.

Provided on the main shaft 42 are a cycle clutch 44 rightwardly of the drive pulley 43 and a carriage return clutch 45 leftwardly of the drive pulley 43.

The cycle clutch 44 includes: a hub 46 fixed onto the main shaft 42; a spring 47 wound around the outer periphery of the hub 46 and the outer periphery of sleeve portion 43A of the drive pulley 43; a cycle cam 48 disposed at the outer periphery of the hub 46 for clamping the spring 47 between the outer periphery of the hub 46 and itself; a clamp 49 for fixing the cycle cam 48 and one end of the spring 47 onto the hub 46 of the main shaft 42 by clamping the outer periphery of a boss portion 48A of the cycle cam 48; and a sleeve 50 concentrically, rotatably coupled onto the main shaft 42 and engaged with the other end of the spring 47.

The spring 47 is wound around the outer periphery of the sleeve portion 43A of the drive pulley 43 with a predetermined value of frictional force being applied to the outer periphery of the sleeve portion 43A.

Figure 9:
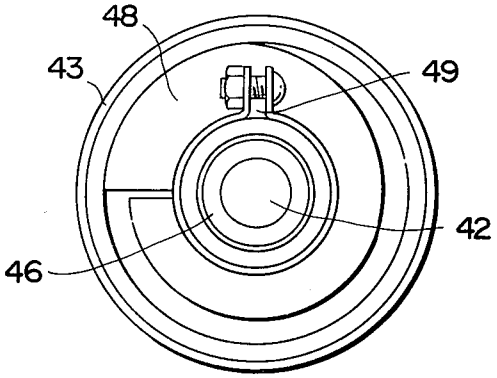
FIG. 9 is an end view in the direction indicated by the arrow from line 9—9 in FIG. 8.

The outer periphery of the cycle cam 48 has a cam-shaped portion as shown in FIG. 9, and, the cycle cam 48 is adapted to turn together with the drive pulley 43 and main shaft 42 in the clockwise direction as viewed from the right side when the cycle clutch 44 is on.

Additionally, an engageable projection 51 is formed on the outer periphery of the sleeve 50.

The clutch bell crank 16 is formed at the right portion thereof with a bifurcated portion 52. The bifurcated portion 52 is formed at one forward end thereof with an engageable portion 53 for being engaged with the engageable portion 51 of the sleeve 50 to prevent the sleeve 50 from rotating in the waiting state (during clutch-off), and at the other forward end thereof with an abutting portion 54 capable of abutting against the cam-shaped portion on the outer periphery of the cycle cam 48.

Figure 10:
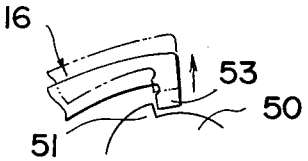
FIG. 10 is an explanatory view showing the engagement of the clutch bell crank with the cycle clutch.

In the cycle clutch 44, when the engageable portion 53 is engaged with the engageable projection 51 as indicated by solid lines in FIG. 10, the sleeve 50 is prevented from rotating and the spring 47 is precluded from being wound into the drive pulley 43, whereby the rotational driving force is not imparted from the drive pulley 43 to the main shaft 42, so that the main shaft 42 remains stopped.

When the clutch bell crank 16 is rotated in the counterclockwise direction and the engageable portion 53 is disengaged from the sleeve 50 as indicated by two-dot chain lines in FIG. 10, the sleeve 50 becomes free, the spring 47 is wound around the drive pulley 43 by the frictional force as tight as possible, whereby the drive pulley 43 and the main shaft 42 are connected to each other through the spring 47, so that the main shaft 42 is rotatingly driven (i.e., the cycle clutch 44 is on).

However, during a full turn of the main shaft 42, the abutting portion 54 of the clutch bell crank 16 is pushed up by a raised portion of the cycle cam 48, and consequently, the clutch bell crank 16 is rotated again in the clockwise direcion, the engageable portion 53 is engaged with the sleeve 50 to prevent the spring 47 from being wound up, whereby the torque is not imparted from the drive pulley 43 to the main shaft 42, so that the clutch 44 is turned off. In other words, the main shaft 42 is adapted to make a full turn when the clutch bell crank 16 is moved in the clockwise direction.

The carriage return clutch 45 includes: a hub portion 55 fixed on the sleeve portion 43A of the drive pulley 43 for being constantly rotated; a carriage return pinion 56 rotatably coupled to the hub portion 55; and a spring 57 loosely wound around the outer periphery of the boss portion 56A of the carriage return pinion 56 and solidly secured at one end thereof to the hub portion 55.

When the actuating arm 22 on the shaft 15 turns in the clockwise direction as viewed from the right side to press the outer periphery of the spring 57 with the forward end portion thereof, the spring 57 is wound into the boss portion 56A of pinion 56, whereby the drive pulley 43 and the pinion 56 are connected to each other, so that the clutch 45 is turned on.

Figure 3:
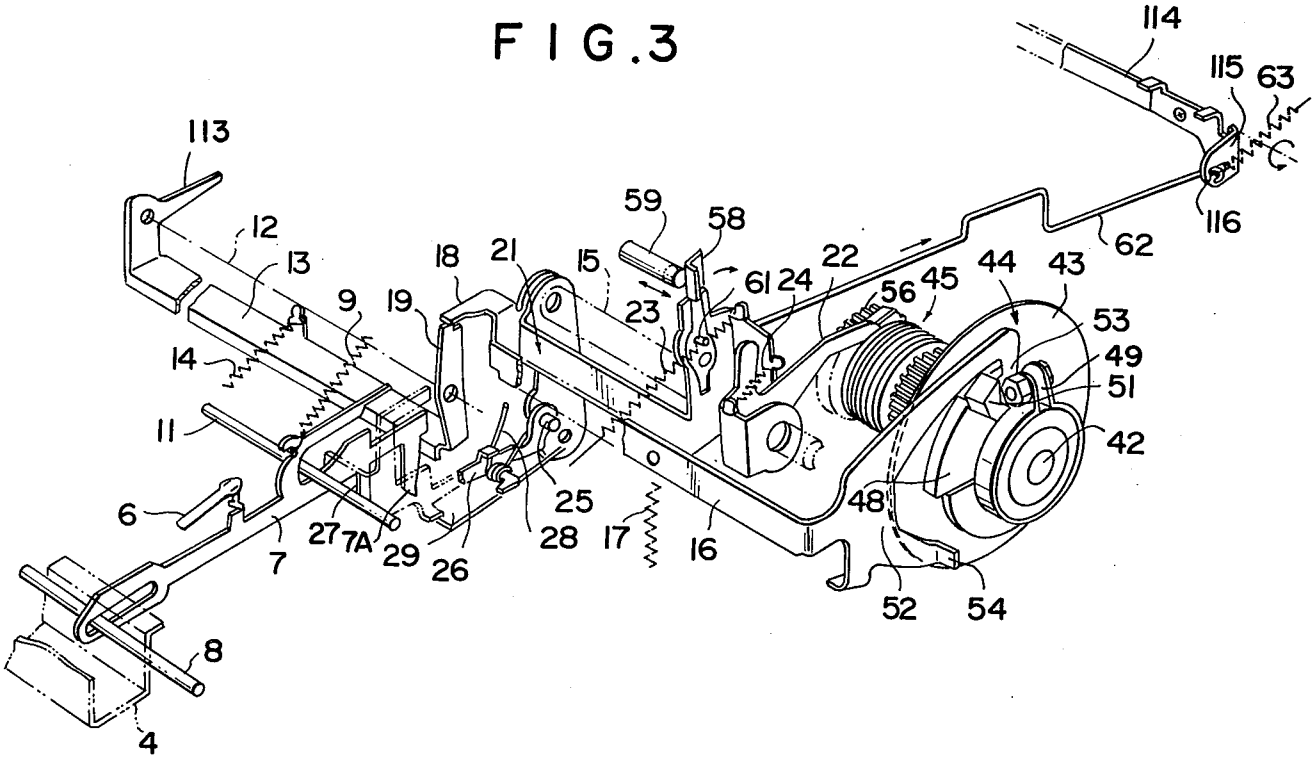
FIG. 3 is a perspective view exemplifying the operating mechanism of the cycle clutch and carriage return clutch.
Figure 4:
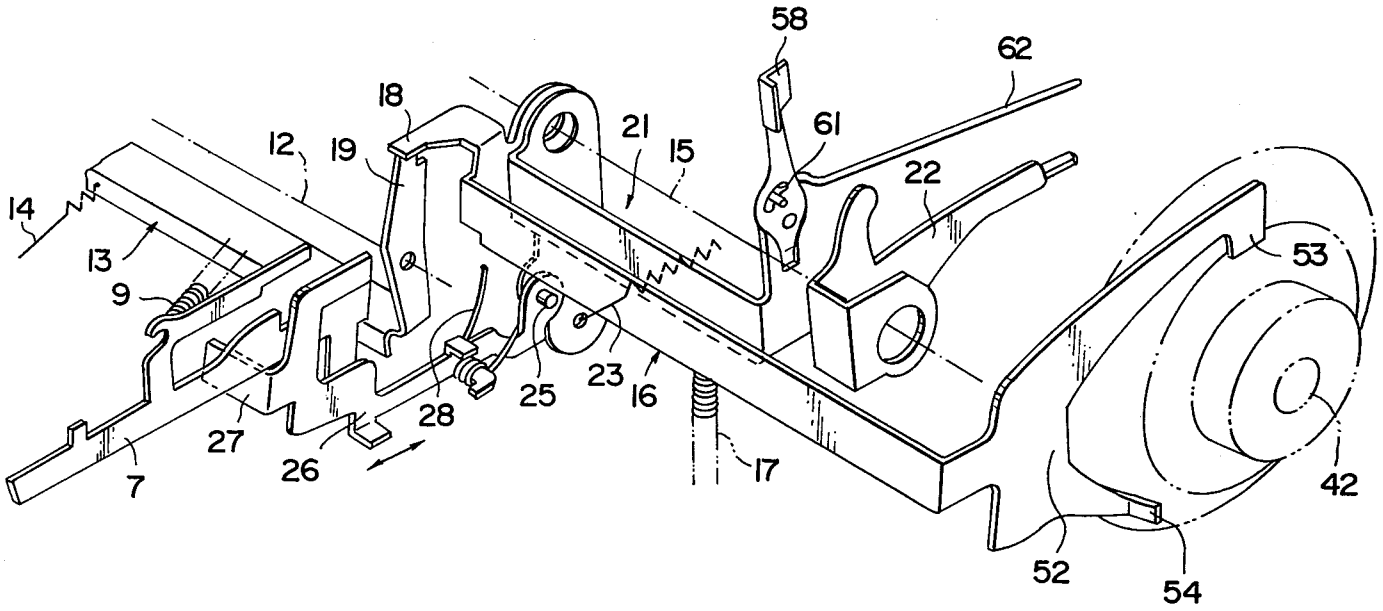
FIG. 4 is a partial perspective view showing the operating mechanism of the clutch bell crank and carriage return bell crank as shown in FIG. 3.

In FIGS. 3 and 4, a movement clutch 58 is solidly secured to the carriage return bell crank 21. The movement clutch 58 is made of a elastically deformable plate material, and, in the waiting state, abuts against the right end face of a margin shaft 59 in a manner to be pressedly deformed to the right as shown in FIG. 3.

During the carriage return, when the carriage return bell crank 21 rotates against the resiliency of the spring 23 in the clockwise direction, the movement clutch 58 moves to the rear of the margin shaft 59 and returns to the left owing to the elasticity thereof. Consequently, unless the margin shaft 59 moves to the left, the carriage return bell crank 21 remains locked at a position, to which it had been rotated in the clockwise direction.

A carriage 60 (Refer to FIG. 12) is slidably supported on the main shaft 42 and adapted to move to the left during the carriage return. When the carriage 60 comes to the left end or a margin stop position, the aforesaid margin shaft 59 can move to the left by a predetermined value by engaging with the carriage 60. Consequently, upon completion of the carriage return, the movement clutch 58 is unlocked, whereby the carriage return bell crank 21 can turn in the counterclockwise direction to return to the original position. Along with the return of this carriage return bell crank 21, also the actuating arm 22 is returned to the original position, whereby the carriage return clutch 45 is turned off, so that the carriage return pinion 56 is stopped.

In addition, the movement clutch 58 is provided therein with a slot 61, into which is loosely coupled an escapement rod 62 extending rearwardly. The escapement rod 62 is urged rearwardly by a spring 63 comparatively low in resilient force which is engaged with the rear end of the escapement rod 62. The force of the spring 63 for urging the carriage return bell crank 21 in the clockwise direction is set at a value considerably lower than the force of the spring 23 for urging the carriage return bell crank 21 in the counterclockwise direction, whereby the former has no considerable effect when the carriage return bell crank 16 is rotated to return.

Figure 5:
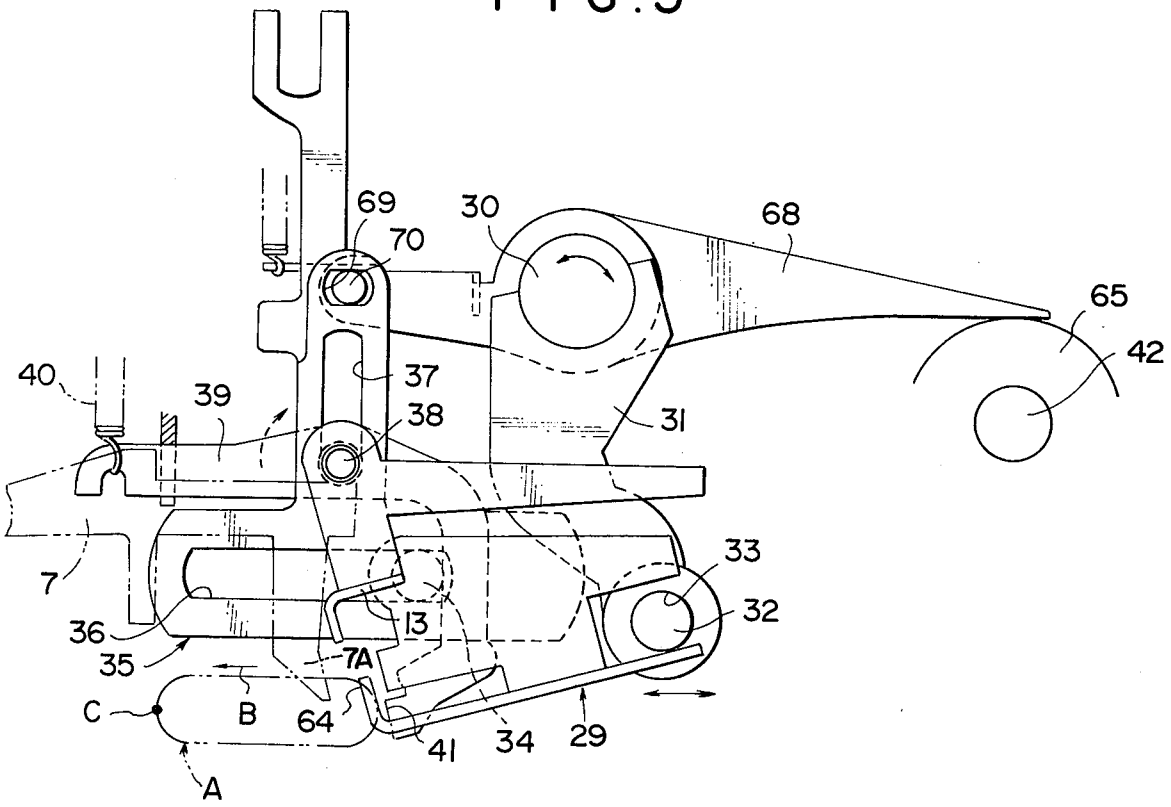
FIG. 5 is a right side view of the device of the present invention exemplifying the mechanism for generating a moving path of the actuating bail.

The main shaft 42 has solidly secured thereto a combination of cams 65, 66 and 67 for rendering to the forward end engageable portion 64 of the actuating bail 29 a motion drawing an elliptical moving path indicated by an arrow A in FIG. 5. This combination of cams 65, 66 and 67 consists of three cams including a cam 65 shown in FIGS. 2 and 5 and a cam 66 shown in FIG. 11.

The first cam 65 is adapted to abut against one end of a crank 68 rotatably supported on the shaft 30 to render to the crank 68 a rocking motion of a predetermined mode. The crank 68 is provided at the other end thereof with a stud 70 loosely coupled into a hole 69 of the bail guide 35. Consequently, along with the rocking movement of the crank 68, the bail guide 35 vertically moves in a predetermined mode.

Figure 11:
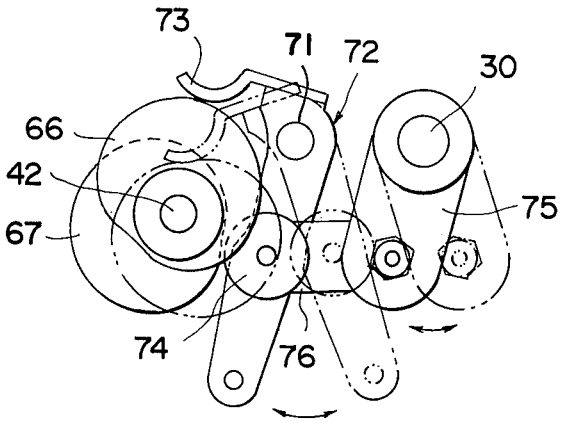
FIG. 11 is a left side view of the device of the present invention exemplifying the rocking mechanism of the actuating cam follower.
Figure 8:
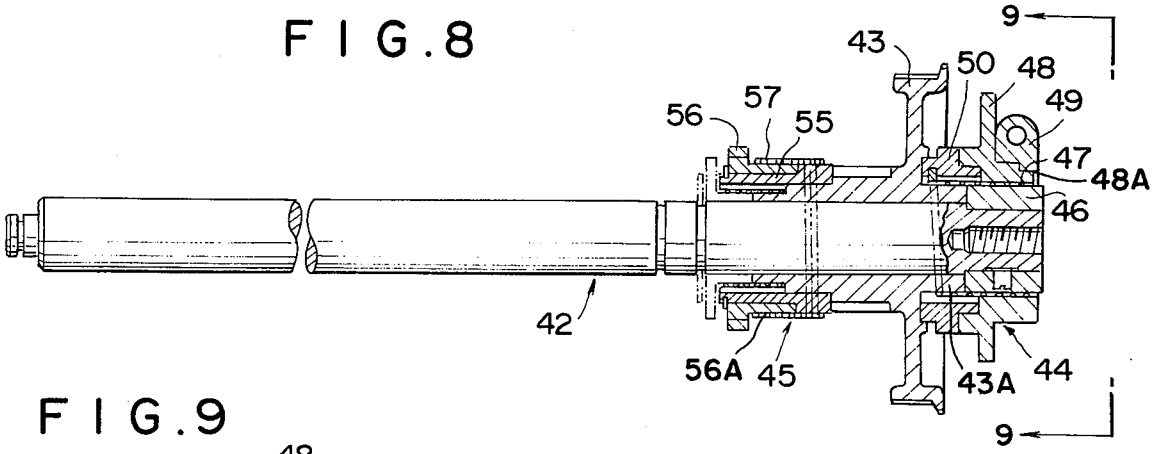
FIG. 8 is a longitudinal sectional view of the cycle clutch and carriage return clutch.

On the other hand, the second cam 66 and the third cam 67 are intended to render to the shaft 30 a rocking motion of a predetermined mode. FIG. 11 is a view of the typewriter as viewed from the left side.

In FIG. 11, pivotally supported on a pivot 71 is an actuating cam follower 72, on which are provided a follower portion 73 for abutting against the second cam 66 and a follower roller 74 for abutting against the third cam 67. Consequently, during a full turn of the main shaft 42, the actuating cam follower 72 rocks between a solid line and a two-dot chain line in FIG. 11.

On the other hand, the shaft 30 has solidly secured thereto a lever 75, which is connected to the actuating cam follower 72 through a link 76.

Consequently, the lever 75 also rocks between a solid line and a two-dot chain line in FIG. 11, and the shaft 30 performs a reciprocating rocking motiion of a predetermined mode (in the rotational direction) during a full turn of the main shaft 42.

As shown in FIG. 5 (as viewed from the right side), the arm 31 is fixed on the shaft 30, also the arm 31 performs the rocking motion in accordance with the rocking motion of the shaft 30 as described above. As a result, the actuating bail 29 performs the rocking motion back and forth through the rod 32 loosely coupled into the hole 33 of the arm 31.

As described above, the pin 34 of the actuating bail 29 is loosely coupled into a laterally elongate hole 36 of the bail guide 35 which is vertically moved by the crank 68, whereby the forward end engageable portion 64 of the actuating bail 29 performs the motion along the elliptical moving path indicated by the arrow A from a home position shown in FIG. 5 during a full turn of the main shaft 42 and returns to the home position as shown.

The forward end engageable portion 64 of the actuating bail 29, during its elliptical motion, abuts against an abutting portion 7A of the interposer 7 which has been pressed down and moved rearwardly during its motion in the forward direction, to thereby move the interposer 7 in a direction indicated by an arrow B (i.e. in the forward direction). However, during its motion along the moving path indicated by the arrow A, when the forward end engageable portion 64 of the actuating bail 29 makes a downward motion to reach a point C, it is disengaged from the interposer 7 which is restored to the original position through the agency of the spring 9 thereof. Upon releasing the interposer 7, the forward end engageable portion 64 of the actuating bail 29 further makes a motion along a rearwardly directed path at the under side and returns to the home position as shown in FIG. 5.

In addition, during its forward movement pushed by the actuating bail 29, the interposer 7 engages the aforesaid carriage return link 26 and moves the same in the forward direction. Thereupon, as apparent from FIGS. 3 and 4, the carriage return bell crank 21 turns in the clockwise direction (as viewed from the right side), whereby the actuating arm 22 also rotates in the clockwise direction to turn the aforesaid carriage return clutch 45 on, so that the carriage return pinion 56 is rotated. Under this condition, since the movement clutch 58 is engaged with the rear side of the margin shaft 59, the carriage return bell crank 21 and the actuating arm 22 are locked at the rotational position of turning the carriage return clutch 45 on in the clockwise direction (as viewed from the right side) until the margin shaft 59 moves to the left, i.e., the carriage 60 reaches the left end or the margin stop position to move the margin shaft 59 to the left.

When the carriage return clutch 45 is on, the carriage return pinion 56 is rotatingly driven by the drive pulley 43. However, the main shaft 42 makes only a full turn and is stopped through the agency of the cycle clutch 44.

Figure 12:
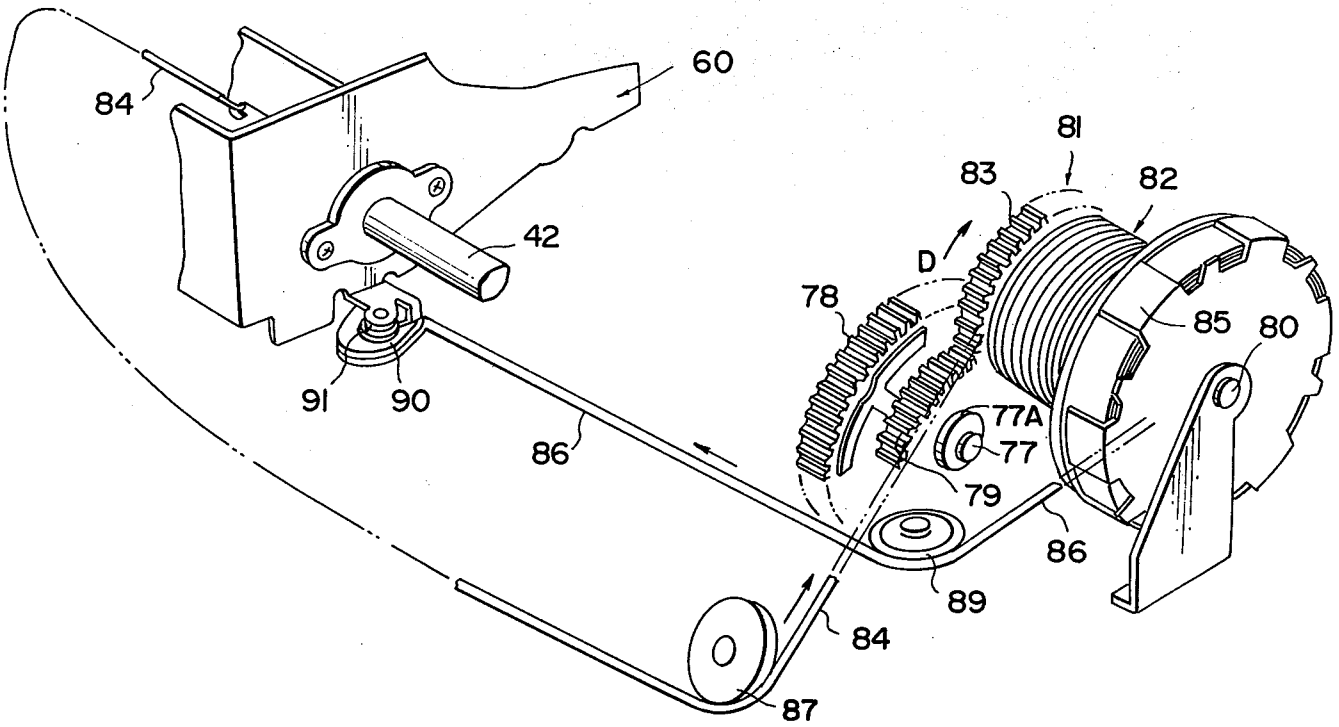
FIG. 12 is a perspective view exemplifying the mechanism for moving the carriage by the rope wound around the cord drum.

In FIG. 12, a large reduction gear 78 meshed with the carriage return pinion 56 is provided on the shaft 77 disposed behind the main shaft 42. The large reduction gear 78 is connected to a small reduction gear 79 on the same shaft 77 through torque restricting means 77A, whereby a torque is transmitted from the large reduction gear 78 to the small reduction gear 79 through frictional resistance.

Disposed behind the shaft 77 is a cord drum shaft 80, on which are provided a left cord drum 81 and a right cord drum 82.

The left cord drum 81 has a drum gear 83 meshed with the aforesaid small reduction gear 79, so that a rope 84 can be wound onto a drum portion thereof. Namely, when the left cord drum 81 is rotatingly driven in a direction indicated by an arrow D in FIG. 12 (in the clockwise direction as viewed from the right side), it winds up the rope 84.

Figures 13, 14:
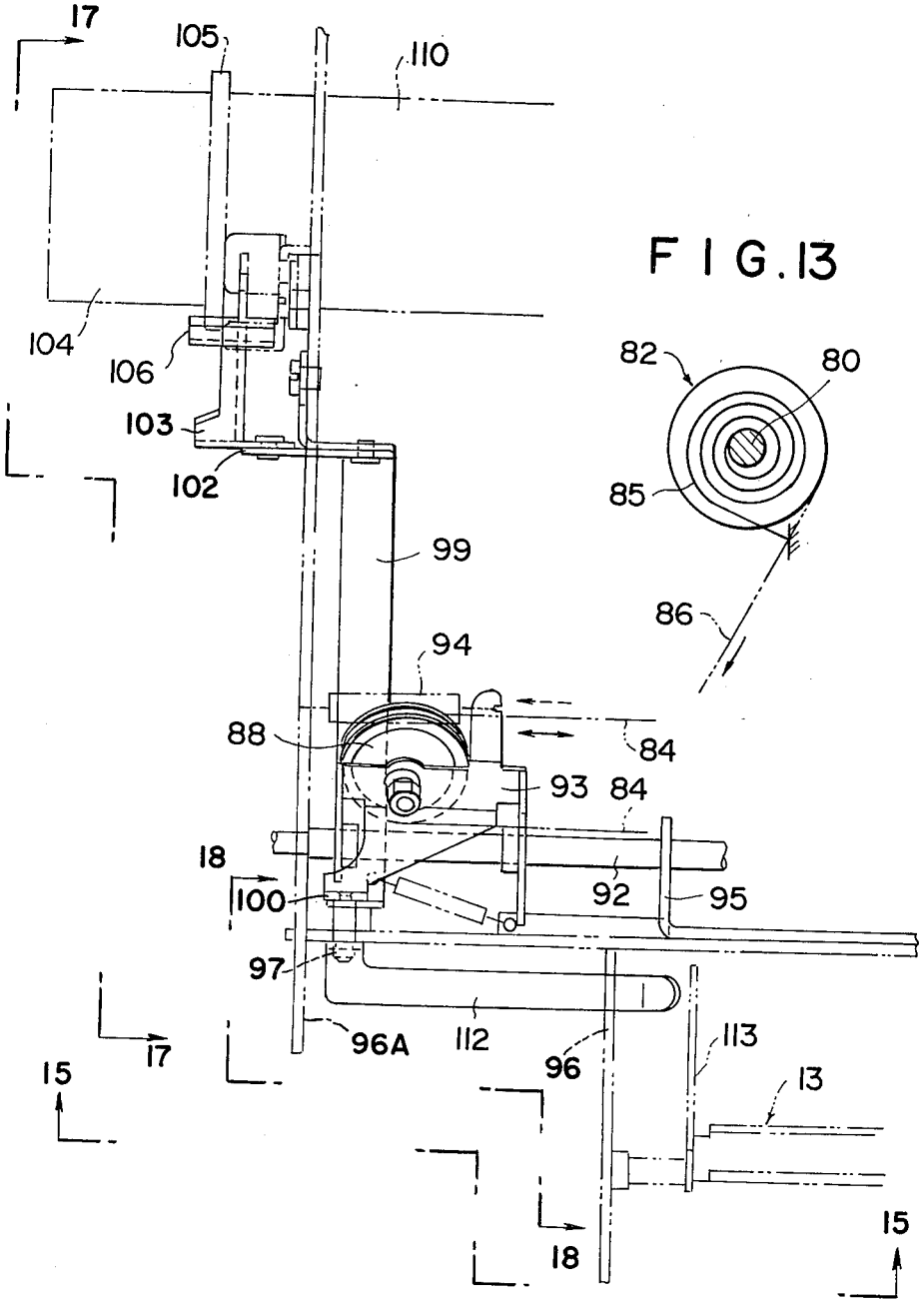
FIG. 13 is an explanatory view exemplifying the state where the rope is withdrawn by the right cord drum.
FIG. 14 is a plan view exemplifying the mechanism in which the operation of carriage return and the platen pitch feed are operationally associated.

The right cord drum 82 has a spiral spring 85 stretched in a direction shown in FIG. 13 as viewed from the right side, and a rope 86 wound around a drum portion thereof is withdrawn by a tensile force against the torque of the spiral spring 85.

Furthermore, in case the left cord drum 81 is rotatingly driven in a direction indicated by arrow D from the waiting state to begin the windup of the rope 84, when it is rotated through a predetermined angle (90° for example), it engages the right cord drum 82, whereby both cord drums 81 and 82 are integrally rotated in a direction indicated by arrow D. The integral rotation makes it possible that the rope 86 identical in length with that of the rope 84 which is wound up by the left cord drum 81 is wound out from the right cord drum 82.

The aforesaid rope 84 passes through an idle pulley 87, is wound at one end around a cord tension pulley 88 provided at the left side of the typewriter as shown in FIGS. 14 through 17, and then, connected at the other end to the carriage 60.

The rope 86 from the right cord drum 82 passes through an idle pulley 89 and is connected to a cord tension pulley 90 secured to the carriage 60. The cord tension pulley 90 is provided thereon with a coil spring 91 for preventing the rope 86 from being slackend off when the carriage 60 moves to the right.

The lengths of the ropes 84 and 86 are sufficient for allowing the carriage 60 to move along the main shaft 42 between the opposite ends thereof.

In FIGS. 14 through 17, the aforesaid cord tension pulley 88 disposed at the left side of the typewriter is secured to a yoke 93 adapted to slide on the shaft 92 by a predetermined distance in the lateral direction. The yoke 93 is urged to the left by a spring 94 lower in resiliency than the tensile force of the spiral spring 85 of the aforesaid right cord drum 82. Reference numeral 95 indicates a stopper for the yoke 93 when it moves to the right.

Figure 16:
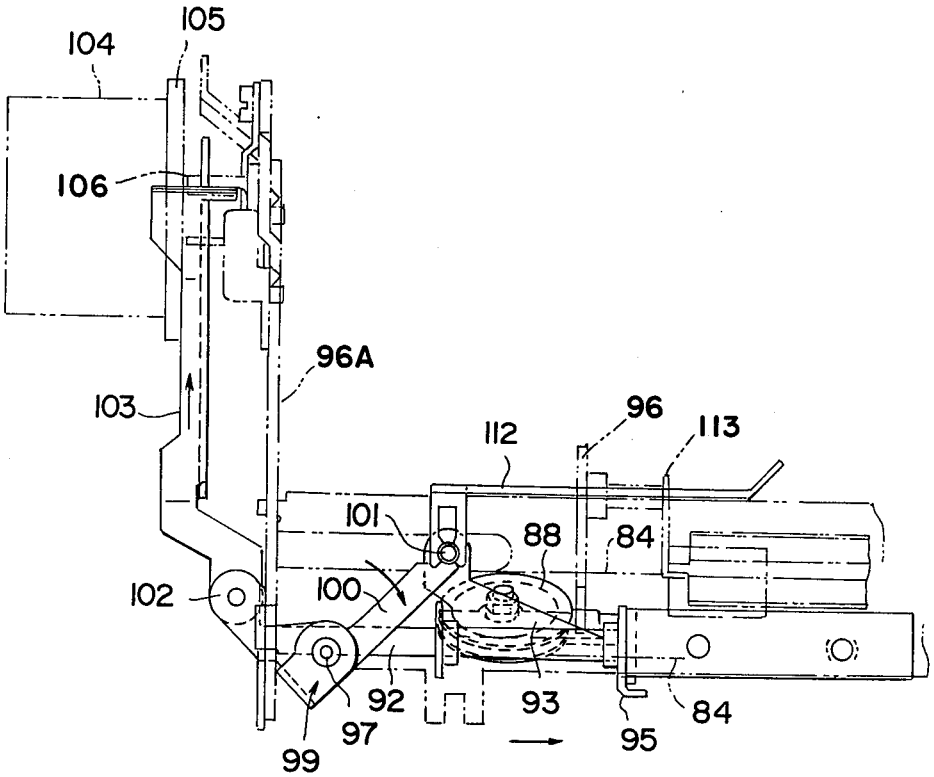
FIG. 16 is a front view corresponding to FIG. 15, showing the moving yoke.
Figure 17:
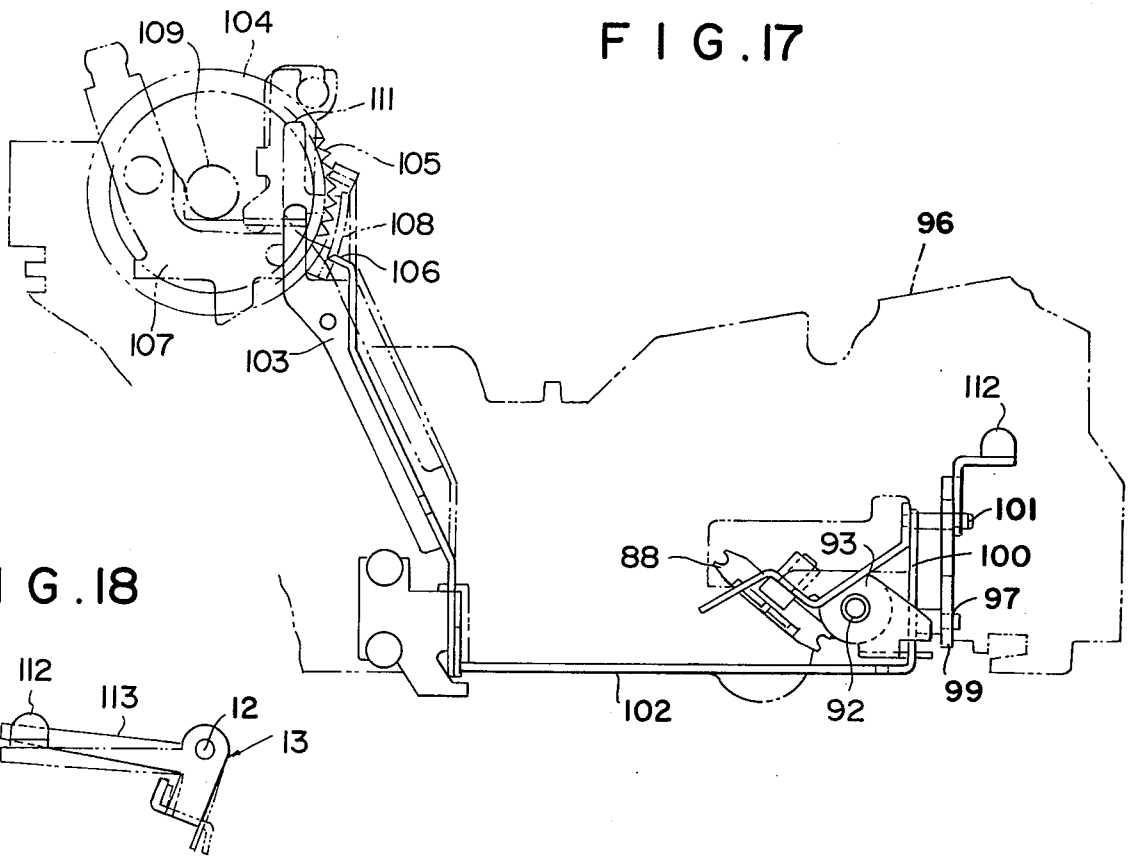
FIG. 17 is a left side view of the device of the present invention taken along the line 17—17 in FIG. 14.

FIG. 16 shows a state where the yoke 93 has moved to the right and abutted against the stopper 95.

Figure 15:
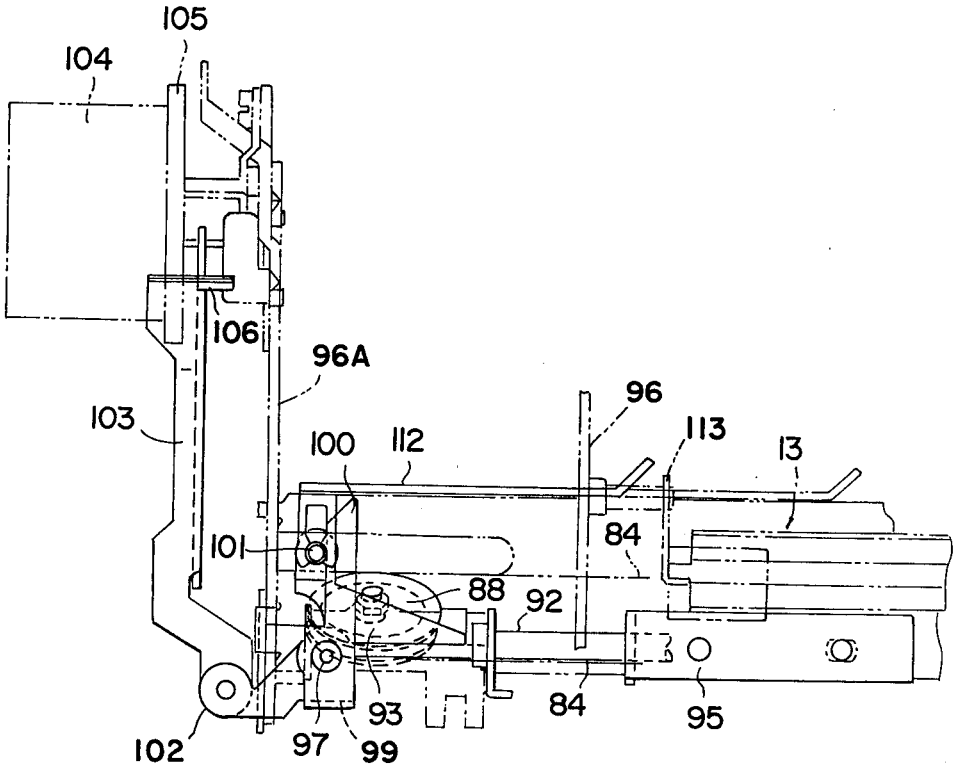
FIG. 15 is a front view taken along the line 15—15 in FIG. 14.

An index pawl carrier 99 is rotatably supported on a fulcrum 97 formed by two studs being concentrical with each other and provided on a left side member 96A of the frame 96 in positions spaced apart from each other in the front and rear portions of the left side member 96A. The index pawl carrier 99 has a bifurcated bell crank shape as viewed in the longitudinal direction, one leg 100 of the bifurcated legs being engaged with a pin 101 of the aforesaid yoke 93 and the other leg 102 pivotally supporting the lower end of the index pawl 103. Consequently, as shown in FIGS. 15 and 16, when the yoke 93 moves to the right, the index pawl carrier 99 turns in the clockwise direction to raise the index pawl 103 upwardly by a predetermined value of stroke.

Formed at the upper portion of the index pawl 103 is a blade portion 106 engageable with a circumferential rack 105 of the platen driver 104. When the index pawl 103 is raised, the blade portion 106 thereof is engaged with the circumferential rack 105. The platen driver 104 can rotate through an angle commensurate to a value of movement from a position of this engagement to the upper limit position of the index pawl 103. Reference numeral 107 indicates an index selector, a guide portion 108 of which can guide the blade portion 106 of the aforesaid index pawl 103. The position of beginning of engagement of the aforesaid blade portion 106 can adjusted by adjusting the height of the guide portion 108 of the index selector 107, so that a feed pitch of the platen driver 104, i.e., a paper feed pitch can be adjusted.

The aforesaid platen driver 104 is secured to a platen shaft 109 so that it can intergrally rotate with a platen 110 mounted on the platen shaft 109 also.

Reference numeral 111 indicates an overthrow stop for preventing the overstroke, i.e., overfeed of the platen driver 104.

Figure 25:
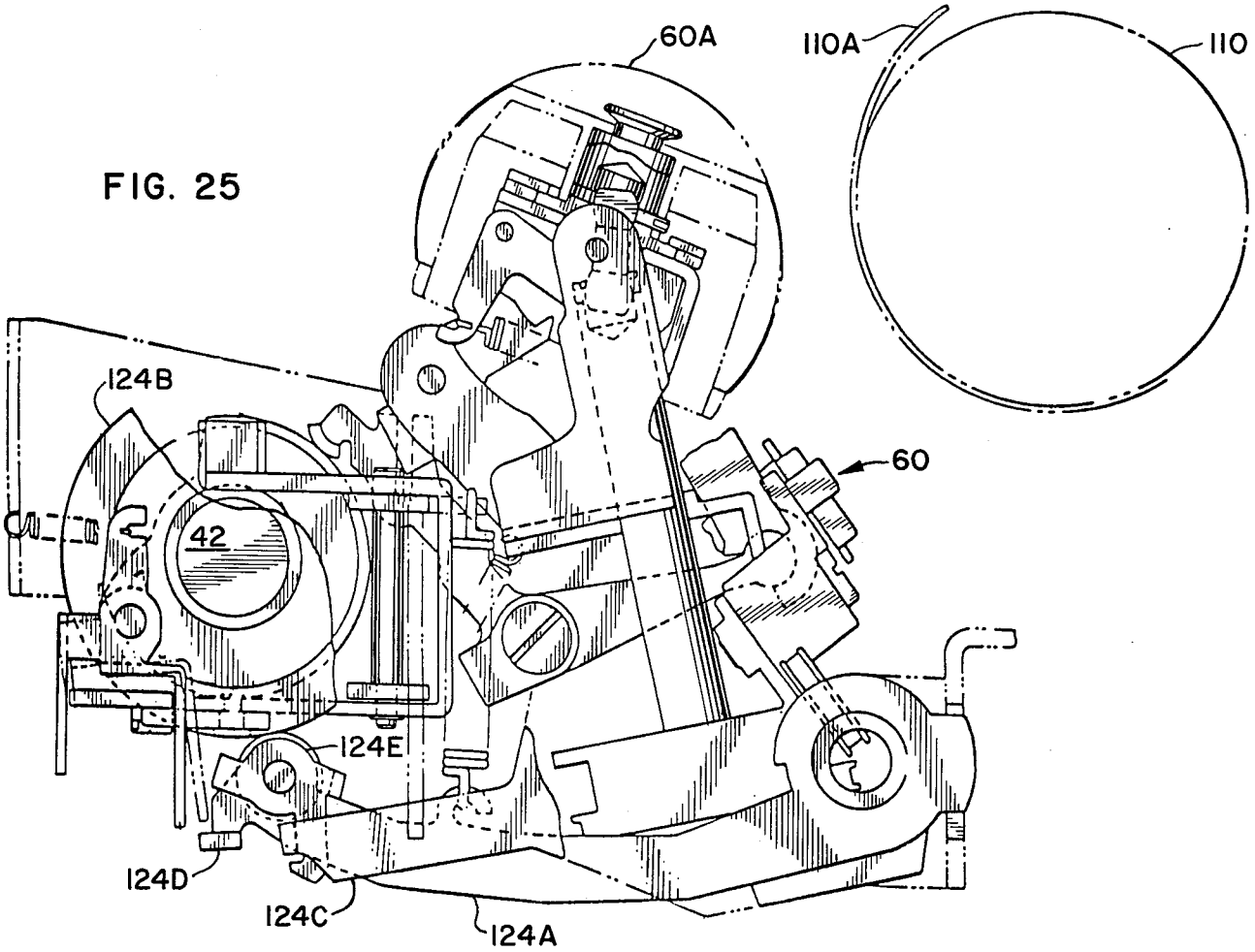
FIG. 25 is a side view of a printing mechanism used in the typewriter of the present invention.

As described above, when the aforesaid yoke 93 and the cord tension pulley 88 are rightwardly moved from a position shown in FIG. 15 to a position shown in FIG. 16, the platen 110 is rotated by a predetermined pitch to feed the paper 110A (shown in FIG. 25).

A latch member 112 is secured to a pin 101 of the yoke 93, while, an arm portion 113 projected rearwardly is provided on the left side end of the aforesaid cycle bail 13 (Refer to FIGS. 14 through 18).

Figure 18:
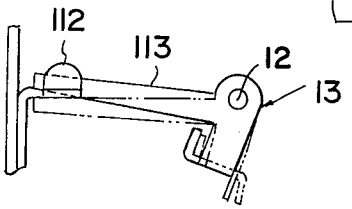
FIG. 18 is a partial left side view of the device of the present invention taken along the line 18—18 in FIG. 14.
Figure 24:
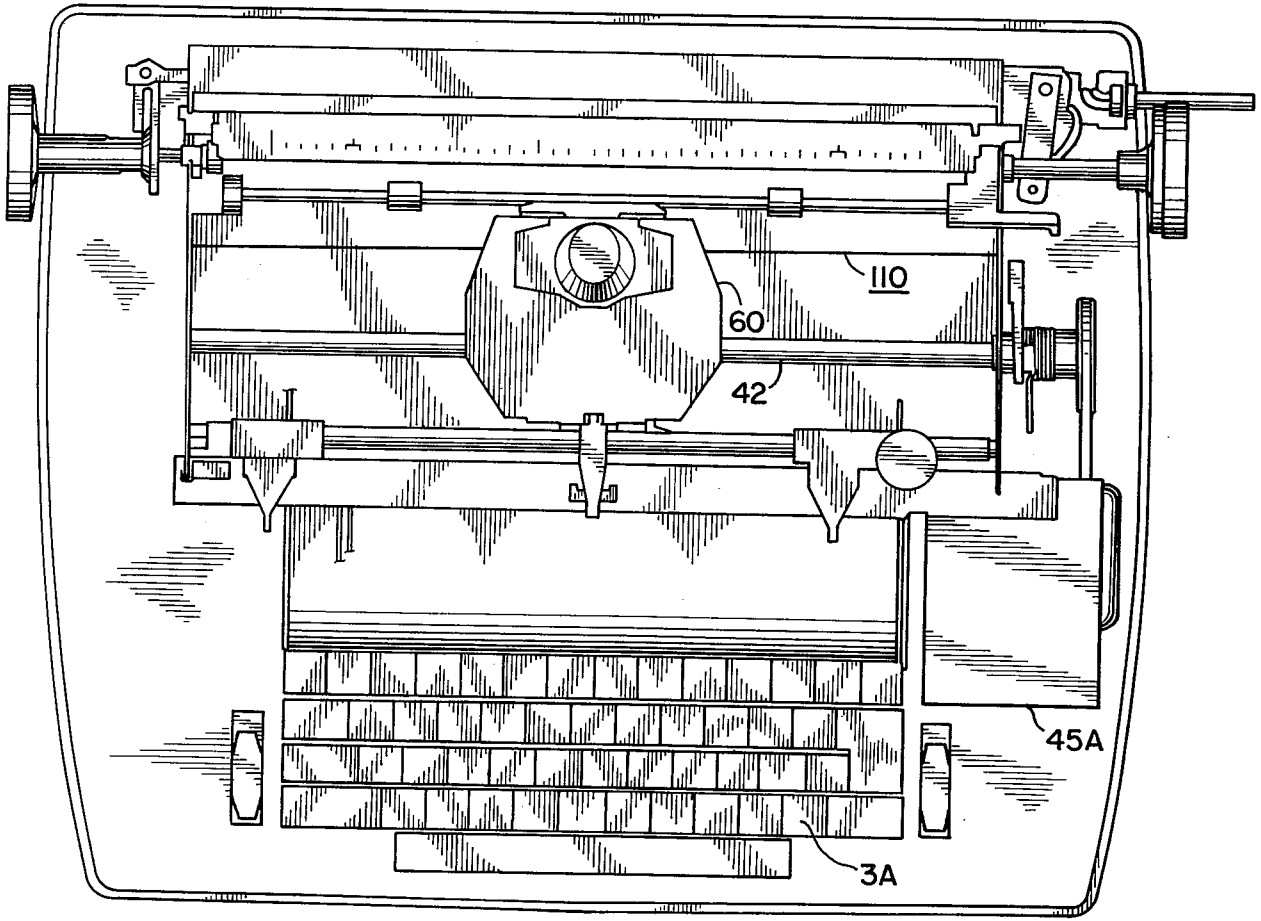
FIG. 24 is a top plan view of a typewriter in accordance with the teachings of the present invention.

This latch member 112, when the yoke 93 moves to the right, advances to a position where it is to be engaged with the aforesaid arm portion 113 (Refer to FIGS. 16 and 18) to thereby prevent the cycle bail 13 from rotating in the counterclockwise direction as viewed from the right side (in the clockwise direction in FIG. 18 as viewed from the left side). Consequently, when the yoke 93 is at a position to the right in FIG. 16 (while the carriage 60 is returning from right to left), the cycle bail 13 is prevented from rotating, and, even if the key lever 3 is depressed to press down the interposer 7 for urging the cycle bail 13, the cycle bail 13 does not rotate, the aforesaid cycle clutch 44 is held off, and the main shaft 42 remains stopped. With the abovedescribed arrangement, even if a letter key 3A (shown in FIG. 24) or the like is accidentally depressed during the carriage return, the printing mechanism (not shown) is prevented from operating to print a letter during the carriage return.

In FIGS. 3 and 19 through 23, the rear end of the escapement rod 62 loosely coupled into the slot 61 of the aforesaid movement clutch 58 is loosely fitted in a slot 116 of a lever 115 fixed on the right side of the escapement torque bar 114.

An escapement pawl 117 as shown in FIGS. 19 through 23 is rockingly supported about a vertical shaft 118 on the carriage 60.

On the other hand, an escapement rack 119 laterally extending is fixed the fixed portion of the typewriter.

Figure 19:
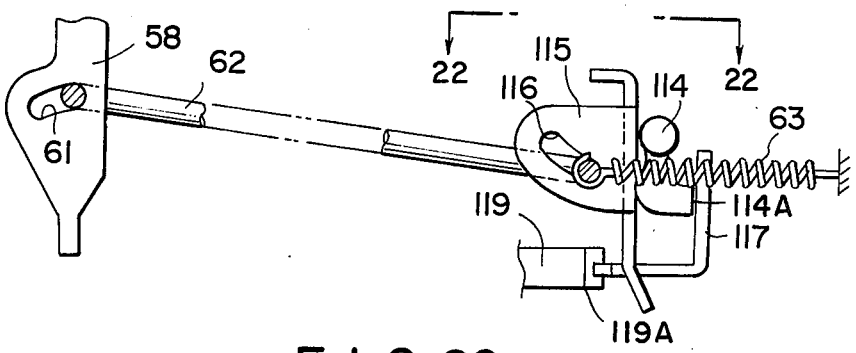
FIG. 19 is a right side view of the device of the present invention exemplifying the positional relationship of the carriage return bell crank with the escapement mechanism in the waiting state.
Figure 22:
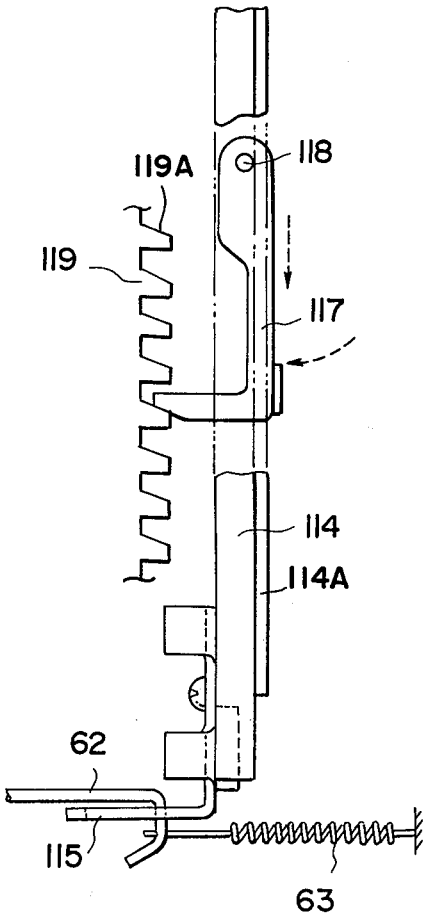
FIG. 22 is a plan view taken along the line 22—22 in FIG. 19.
Figure 23:
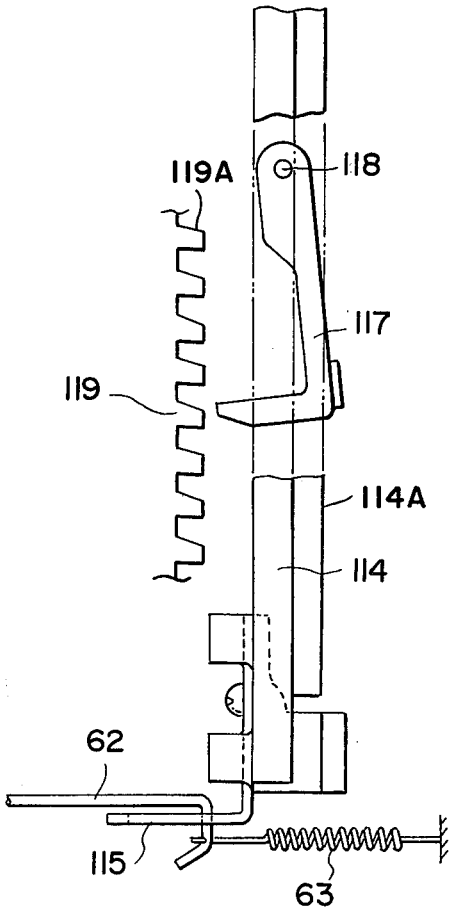
FIG. 23 is a plan view taken along the line 23—23 in FIG. 21.

The aforesaid escapement pawl 117 is urged by a spring (not shown) having a suitable resiliency acting through the end 114A of the escapement torque bar 114 in the counterclockwise direction in FIGS. 22 and 23, and, in the waiting state as shown in FIGS. 19 and 22, i.e., the carriage return bell crank 21 is at the original position and the movement clutch 58 is at a position in the counterclockwise direction, the escapement pawl 117 is held by the aforesaid spring (not shown) at a position of being engaged with a tooth portion 119A of the rack 119. Namely, in this case, as shown in FIG. 19, the rod 62 cannot move rearwardly, so that the spring 63 does not rotate the escapement torque bar 114.

Figure 20:
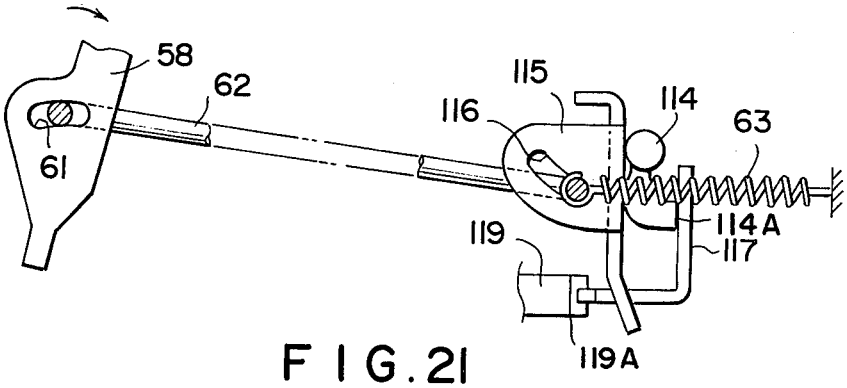
FIG. 20 is a right side view of the device of the present invention corresponding to FIG. 19, showing the carriage return bell crank at the initial stage of rotation.

When the carriage return bell crank 21 rotates in the clockwise direction from the abovedescribed waiting state, the state shown in FIG. 20 is brought about. The reason is that, since the carriage 60 is urged to the right by the spiral spring 85 of the aforesaid right cord drum 82 through the rope 86, a frictional force is generated at contact portions of the escapement pawl 117 and the escapement rack 119, the force for retaining the escapement pawl 117 due to this frictional force is higher in value than the turning force of the escapement torque bar 114 rendered by the spring 63.

Figure 21:
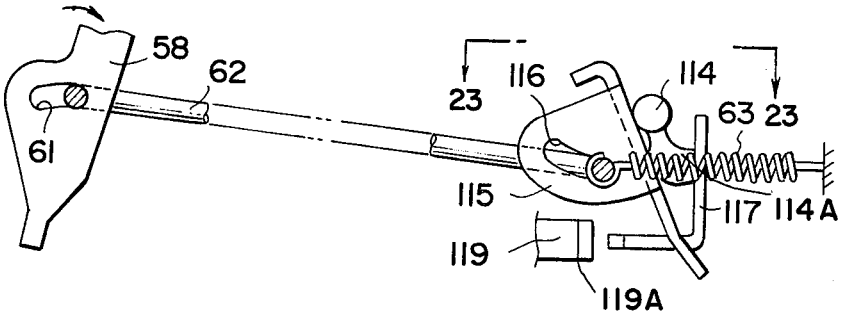
FIG. 21 is a right side view of the device of the present invention corresponding to FIG. 19, showing the carriage moving during the carriage return.

Subsequently, the carriage return clutch 45 is turned on by the actuation of the actuating arm 22, the carriage return pinion 56 begins to rotate and the rope 84 is wound onto the left cord drum 81 to move the yoke 93 to the right, and thereafter, when the carriage 60 begins to move to the left, the frictional force between the escapement pawl 117 and the escapement rack 119 disappears. Consequently, through the resiliency of the spring 63, the escapement rod 62 is pulled rearwardly by a length of play between the slot 61 and the rod 62 as shown in FIG. 20 and the slot 116 of the lever 115 is engaged with the rod 62, whereby the escapement torque bar 114 is rotated in the counterclockwise direction since the end 114A of the bar 114 is not prevented from rotating by the pawl 117, so that the state shown in FIGS. 21 and 23 is brought about.

While the carriage 60 moves from right to left as described above, the escapement pawl 117 and the escapement rack 119 are completely disengaged from each other and do not contact each other, so that the carriage 60 can move quietly and smoothly. In other words, a quiet and smooth carriage return can be effected.

Since the main shaft 42 makes a full turn during the carriage return, a group of cams constituting a part of the printing mechanism in the carriage 60, i.e., the printing cam 124B and the detent cam 124E respectively, make a full turn, a rocking motion of the typehead 60A toward the platen 110 is generated when things are left as they are. It is necessary to prevent such a rocking motion of the typehead 60A during the carriage return by the provision of some stopper 124D or other.

For this purpose, there is provided a space interposer follower 120 (Refer to FIG. 2) which rotates in the counterclockwise direction at the same time as the carriage return bell crank 21 is rotated by the interposer 7 in the clockwise direction (as viewed from the right side).

Figure 2:
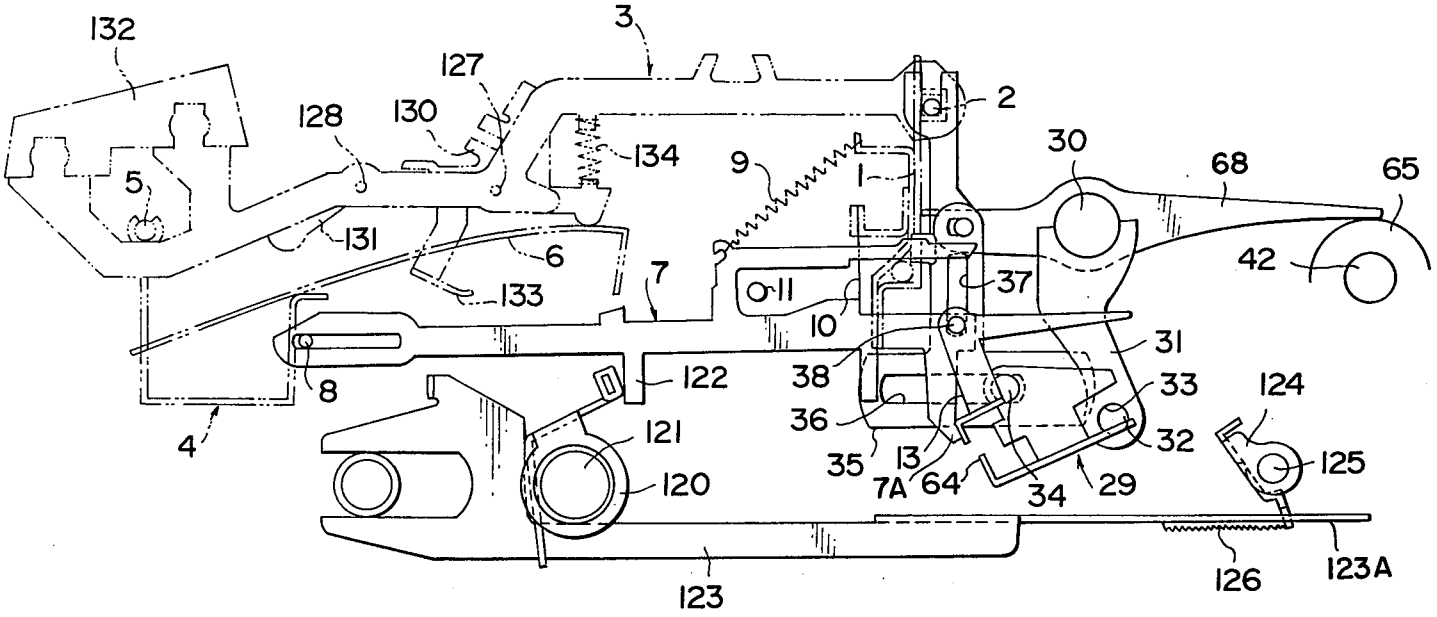
FIG. 2 is a left side view of the device of the present invention exemplifying the arrangement of the carriage return lever, interposer, backspace rack link and actuating bail, and parts associated therewith.

In FIG. 2, the aforesaid space interposer follower 120 is rotatably mounted about a shaft 121 solidly secured to the frame 96. The space interposer follower 120 is rotated by a projection 122 of the interposer 7, when the interposer 7 moves rearwardly. Rotation of this space interposer follower 120 causes a backspace rack link 123 riding on follower 120 to move forwardly (leftwardly), whereby a backspace rack 124 operationally associated therewith turns in the clockwise direction (as viewed from the right side). This backspace rack 124 is a laterally elongate member, which is pivotally supported by a shaft 125, normally urged by a spring 126 in the clockwise direction, but, prevented from rotating by a stepped portion 123A of the backspace rack link 123.

When the backspace rack link 123 moves leftwardly (in the FIG. 2) and the backspace rack 124 rotates in the clockwise direction, the printing arm 124A following the printing cam 124B in the carriage 60 is locked, whereby the printing arm 124A is held at the home position despite rotation of the printing cam 124B (solidly secured to the main shaft 42). Consequently, the rocker bracket 124C rotatable by the upward rocking motion of the printing arm 124A and the typehead 60A fastened thereto remain held at the home positions, so that the typehead 60A does not perform printing.

In FIG. 1, pivotally supported through pins 127 and 128, respectively, on the carriage return key lever 3 are a first repeat lever 130 and a second repeat lever 131, which are freely movably connected to each other through an engageable portion 129. Provided at the lower end of the first repeat lever 130 is an abutting portion 133 which comes into contact with the interposer 7 when a key top 132 is deeply depressed, a compression spring 134 is stretched between the first repeat lever 130 and the key lever 3, and, an engageable portion 135 engageable with the key lever 3 is provided on the first repeat lever 130. The first repeat lever 130 is held by this compression spring 134 and the engageable portion 135 at a position shown in FIG. 1.

When the key top 132 is deeply depressed, the aforesaid abutting portion 133 presses down the interposer 7, whereby the aforesaid cycle bail 13 (Refer to FIG. 3) is urged by the interposer 7. However, since, during the carriage return, the cycle bail 13 is prevented from rotating by the stop spring 28 of the carriage return link 26 (Refer to FIGS. 3 and 4) and the latch portion 112 (Refer to FIGS. 14 through 18) on the yoke 93, no change from the normal key handling is seen during the carriage return. However, when the stop spring 28 and the latch member 112 are disengaged from the cycle bail 13 upon completion of returning the carriage 60, the cycle bail 13 and the clutch bell crank 16 rotate to turn the cycle clutch 44 on, whereby the main shaft 42 makes a full turn, so that the carriage return clutch 45 is turned on by the carriage return link 26, the left cord drum 81 rotates in the direction of winding the rope 84 up, and the yoke 93 (Refer to FIGS. 15 and 16) moves to the right to turn the platen 110 at a predetermined pitch, thereby effecting the paper feed. When the right cord drum 82 and the left cord drum 81 are engaged with each other to begin the integral rotation, the carriage 60 pulls the margin shaft 59 to the left, whereby the carriage return bell crank 21 and the actuating arm 22 are returned to the original positions and the carriage return clutch 45 is turned off, so that the original state is restored.

Further, the key top 132 is continued to be deeply depressed, the typewriter repeats the abovedescribed motion and the paper feed can be continued with the carriage 60 being at the position where it is margin-stopped.

In the abovedescribed embodiment, when the key top 132 for the carriage return is depressed, firstly, the cycle bail 13 is rotated by the interposer 7 to turn the clutch bell crank 16, so that the cycle clutch 44 is turned on and the main shaft 42 makes a full turn.

This rotation of the main shaft 42 renders to the actuating bail 29 the elliptical motion of the predetermined mode through the combination of cams 65, 66, 67, the crank 68 and the bail guide 35.

When the interposer 7 moves in association with the motion of this actuating bail 29, the carriage return link 26 moves forwardly, whereby the carriage return bell crank 21 is rotated to effect the carriage return (the leftward movement of the carriage 60).

Since, during the carriage return, firstly the cycle bail 13 is prevented from rotating, printing is avoided even if the printing key 3A or the like is accidentally pressed.

Furthermore, since, during the carriage return, the escapement torque bar 114 is rotated by the escapement rod 62 connected to the movement clutch 58 and the spring 63 and the escapement pawl 117 of the carriage 60 is released from the escapement rack 119, a quiet and smooth operation of carriage return can be obtained.

Further, the avoidance of printing when the key top 132 for the carriage return is depressed can be achieved in such a manner that the backspace rack 124 is rotated by the backspace rack link 123 operationally associated with the interposer 7, whereby the printing arm 124A of the carriage 60 is stopped in operation.

Still further, since the rope 84 connecting the left cord drum 81 to the carriage 60 is stretched through the cord tension pulley 88 and the yoke 93 supporting the cord tension pulley 88 is urged by the spring 94 lower in resiliency than that of the spiral spring 85 of the right cord drum 82, during the carriage return the yoke 93 is moved to the right a predetermined distance and the index pawl 103 operationally associated with the yoke 93 is raised to drive the platen 110, so that the paper feed can be effected. In this case, the meshing drive distance between the index pawl 103 and the platen driver 104 can be adjusted by the index selector 107, so that the paper feed pitch can be adjusted.

As apparent from the foregoing, according to the present invention, the carriage return device simplified in construction and operable reliably can be obtained.

What is claimed is:

1. A carriage return device in a typewriter comprising:

an interposer operable through operation of a key lever for a carriage return;

a cycle bail driven by the interposer;

an actuating bail for performing a cycle of movement having a locus of a predetermined mode to cause the interposer to disengage from the cycle bail;

a carriage return bell crank for operation in association with the interposer when the interposer moves in the direction of disengaging from the cycle bail;

a carriage return clutch operable by the carriage return bell crank;

a carriage driving device for driving a carriage to return through operation of the carriage return clutch, said carriage driving device comprising a stationary mechanism for releasing the carriage from an escapement rack in association with said carriage return bell crank; and a mechanism operable to return the carriage return bell crank upon completion of carriage return;

characterized in that said actuating bail is driven to perform said movement by a main shaft connected with a driving source through a cycle clutch, which is associated with said cycle bail for intermittently transmitting a driving force from the driving source to the main shaft so that the main shaft can rotate by a predetermined number of times, and that said carriage driving device further comprises:

a rope connected with the carriage for driving the carriage; and a tension pulley around which said rope is wound and which is connected with a platen driving means for driving a platen by one feed pitch in order to feed paper by one pitch, said tension pulley being displaceable by a predetermined stroke under a lower tension of said rope than a tension to drive the carriage, whereby, when said rope is pulled, said tension pulley displaces by a predetermined stroke to effect the feeding of the paper by one pitch, and then the carriage is driven to return.

2. A carriage return device as set forth in claim 1, wherein said platen driving means operates during a lag provided between the start of operation of said carriage return clutch and the driving of said carriage.

* * * * *